United States Patent [19]

Cronin

[11] 4,190,926

[45] Mar. 4, 1980

[54] DOOR GUARD

[76] Inventor: John Cronin, 8510 W. Layton Ave., Greenfield, Wis. 53228

[21] Appl. No.: 15,710

[22] Filed: Feb. 27, 1979

[51] Int. Cl.[2] ..... E05F 3/00

[52] U.S. Cl. ..... 16/65; 16/70; 16/80

[58] Field of Search ..... 16/49, 51, 52, 61, 63, 16/65, 66, 67, 70, 71, 72, 73, 78, 80–85

[56] References Cited

U.S. PATENT DOCUMENTS

| | | | |
|---|---|---|---|
| 890,207 | 6/1908 | Anderson | 16/84 |
| 1,916,882 | 7/1933 | Greene | 16/82 |
| 2,044,865 | 6/1936 | Van Arsdel | 16/84 |
| 2,056,876 | 10/1936 | Williams | 16/82 |
| 2,064,995 | 12/1936 | Van Arsdel | 16/84 |
| 2,119,589 | 6/1938 | Lutz | 16/84 |
| 3,369,833 | 2/1968 | Schaldenbrand | 16/82 X |
| 3,378,878 | 4/1968 | Flint et al. | 16/52 |
| 3,986,742 | 10/1976 | Heaney | 16/82 X |

*Primary Examiner*—Andrew V. Kundrat
*Attorney, Agent, or Firm*—Quarles & Brady

[57] ABSTRACT

A door guard for a swingable door that is mounted in a doorway having a door closer affixed to the doorway permits the door to open beyond the point which would normally be the widest open position allowed by the door closer and slows the rate of movement of the door so as to prevent damage to the door, door closer, or doorway. The door guard includes a flexible resilient arm extending transversely across the inside of the door and connected to the door closer at a point intermediate its ends, said arm is anchored at its inner end to the door and has its outer end releasably attached to the door, and catch means mounted on the door for releasably attaching the outer end of the arm to the door. When a force such as a gust of wind causes the door to fly open, such that the door closer reaches its fully extended position, the outer end of the arm is released by the catch means and the arm flexes to permit the door to continue opening. The further opening of the door is slowed by the resistance of the arm to flexing thus preventing damage to the door, door closer or doorway. The resistance may be provided by the inherent resiliency of the arm itself or by some other resilient member, such as a coil spring secured between the arm and the door.

10 Claims, 7 Drawing Figures

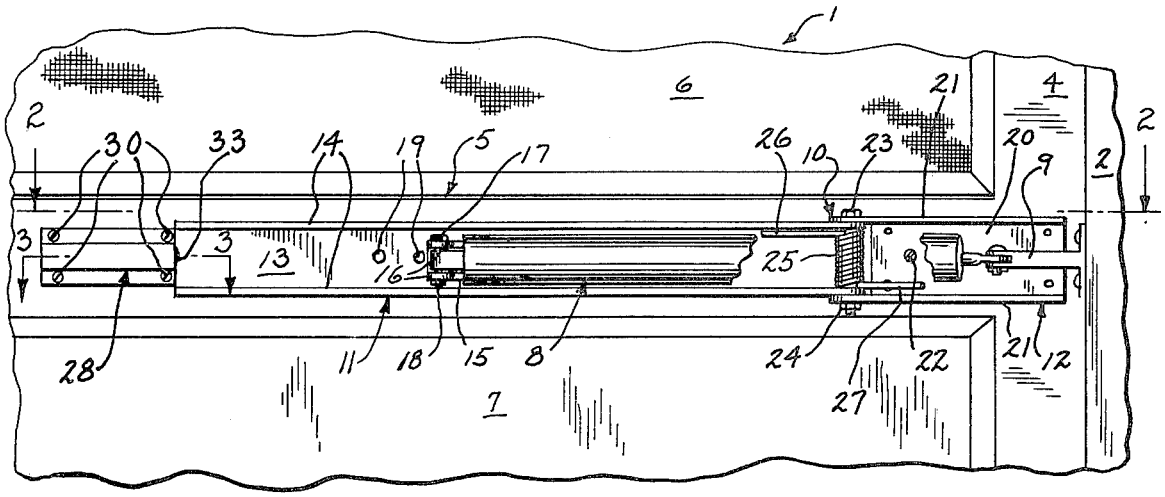
Fig. 1
Fig. 2
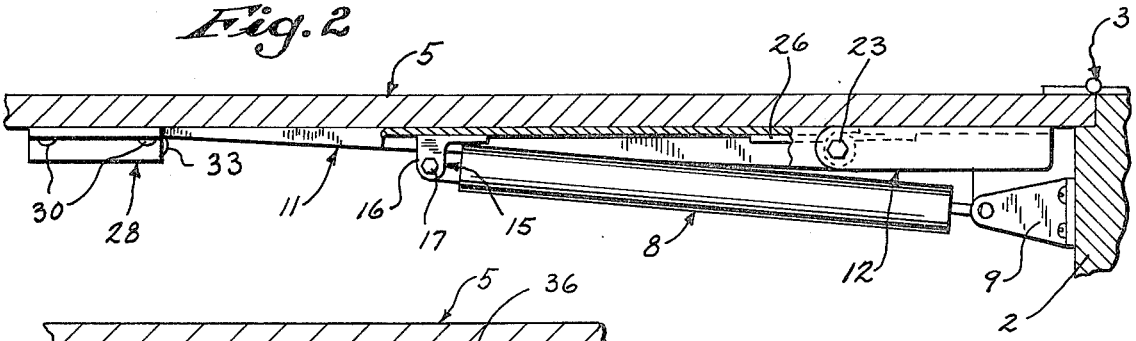
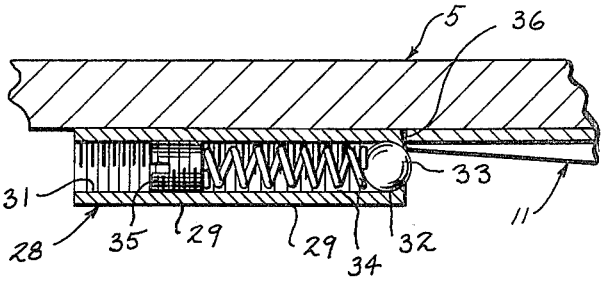
Fig. 3
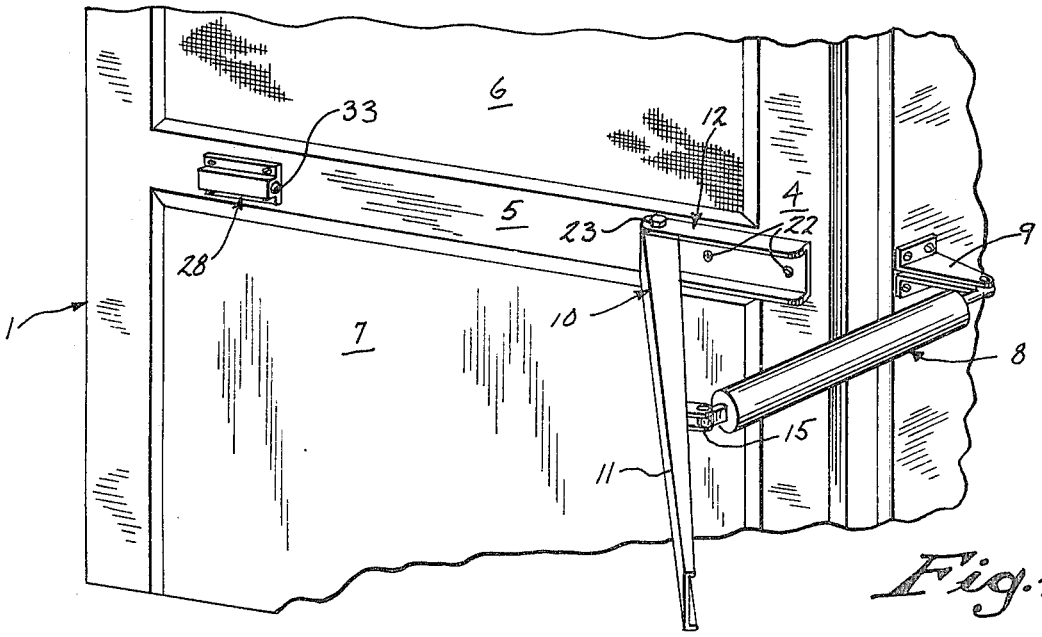
Fig. 4

DOOR GUARD

BACKGROUND OF THE INVENTION

The present invention relates to a door assembly, and more particularly to a door guard that permits the opening of a door beyond the normally widest open position allowed by a door closer and slows the rate of movement of the door so as to prevent damage of the door assembly.

Storm doors and other types of swingable doors mounted in doorways may at times be blown open by a strong gust of wind. When this occurs, it is desirable to have a device that will prevent the door and its assembly from being damaged. To solve this problem the prior art has provided devices such as that disclosed in U.S. Pat. No. 3,369,833 issued to Schaldenbrand on Feb. 20, 1968. There, a detent pocket formed in an elongated link receives a crossbar mounted on a door. This enables the door to be held open in various selected positions. These types of devices, however, cause a nearly instantaneous stopping of the door, and consequently, glass mounted in the door may shatter, or the device may be ripped from its hinges causing damage to its mounting.

It is apparent, therefore, that a device is needed to slow down or decelerate the opening of a door so as to prevent such damage. One such device is disclosed in U.S. Pat. No. 2,119,589 issued to Lutz on June 7, 1938. Lutz discloses a bellows connected to a series of links that extends between a door and its frame. Another device is disclosed in U.S. Pat. No. 2,056,876 issued to Williams on Oct. 6, 1936. Williams uses a mechanism having adjustable brake shoes and linings which engage a facing strip to resist the movement of a door. Other mechanisms have used piston-cylinder arrangements such as in U.S. Pat. No. 3,378,878 issued to Flint et al on Apr. 23, 1968, and U.S. Pat. Nos. 2,064,995 and 2,044,865. Still another approach has been to use a spring mechanism such as those disclosed in U.S. Pat. Nos. 3,986,742 and 1,916,882. None of these arrangements are entirely satisfactory, however, and the present arrangement has been developed to provide an improved means which permits the opening of a door beyond the normally widest open position allowed by a door closer at a relatively slow rate to prevent damage to the door and its surrounding assembly.

SUMMARY OF THE INVENTION

The present invention relates to a door guard for a swingable door mounted in a doorway which permits the opening of the door beyond the normally widest open position allowed by a door closer and slows the rate of movement of the door so as to prevent damage to the door, door closer or doorway. More specifically, the invention resides in a flexible resilient arm which extends transversely across the inside of a door, said arm being anchored at its inner end and releasably attached at its outer end to the door, and connected intermediate its length to a door closer, and a catch means mounted on the door for releasably attaching the other end of the arm to the door. When a force such as the wind causes the door to fly open such that the door closer reaches its fully extended position, the outer end of the arm is released by the catch means and the arm flexes to permit the door to continue opening. The further opening of the door is slowed by the resistance of the arm to flexing thus preventing damage to the door, door closer or doorway.

A door assembly normally includes a door mounted in a doorway which swings open to a maximum open position allowed by a door closer. Doors may at times be blown open by the wind with considerable force. Such force creates high stresses on the door and door closer as the door stops at its widest open position, and may result in the door closer itself being damaged or ripped from the doorway or damage to the door itself. In order to prevent this type of damage, the force of the wind must be counteracted and resisted within the relatively compact area of the door assembly. The present invention seeks to solve this problem by providing a door guard that is passive during normal entry and exit through the door, but which functions to permit the opening of the door beyond the widest open position normally allowed by the door closer at a relatively slow rate to prevent damage to the door and its assembly. In one form, there is a two-piece arm which includes an outer arm releasably attached at one end to the inside of a door and having a pivot or elbow connection at its other end with an inner arm which is securely mounted to the inside of the door. The outer arm is also connected intermediate its ends to a conventional spring loaded door closer and a catch means mounted on the inside of the door provides for the releasable attachment of the outer arm to the door. A coil spring is disposed at the elbow or pivot connection between the outer and inner arms for resisting any pivotal movement that may occur between these arms. Thus, when the door is opened to the widest open position allowed by the door closer and a force such as the wind continues to be exerted thereon, the door closer will exert a force on the outer arm and cause it to be released by the catch means. The outer arm flexes or pivots at its elbow with respect to the inner arm and door allowing the door to continue opening, but at a relatively slower rate because the coil spring is resisting this movement. Damage to the door and its assembly is unlikely due to the slowing down of the door.

It is an object of the invention to provide a means for preventing damage to a door, door closer or doorway when the door is blown open by the wind, or is thrown open by some other force.

It is another object of the invention to provide a door guard that is passive during normal entry and exit through a door, but which functions to permit the door to open beyond its normally widest open position at the same time it applies a force resisting such further opening.

It is another object of the invention to provide a door guard which not only prevents damage to a door, but also allows the door to close after being opened without unnecessary slamming.

It is still another object of the invention to provide a door guard that may easily be reset with a minimum of effort into a locked position after it has functioned to prevent damage to a door.

It is yet another object of the invention to provide a door guard that is reliable, easy to install and maintain, and which readily adapts to the relatively compact area of a door assembly.

The foregoing and other objects and advantages of the invention will appear from the following description. In the description, reference is made to the accompanying drawings which form a part hereof, and in which there is shown by way of illustration and not of limitation preferred embodiments of the invention. Such embodiments do not represent the full scope of the invention, but rather the invention may be employed in other different embodiments, and reference is made to the claims herein for interpreting the breadth of the invention.

BRIEF DESCRIPTION OF THE DRAWINGS

FIG. 1 is a fragmentary side view in elevation, with parts cut away, of a door assembly showing a door guard constituting a first embodiment of the present invention;

FIG. 2 is a fragmentary top plan view, with parts cut away, taken through the plane of the line 2—2 indicated in FIG. 1;

FIG. 3 is a fragmentary view in cross-section taken through the plane of the line 3—3 indicated in FIG. 1;

FIG. 4 is a fragmentary view in perspective of a door assembly illustrating the breakway position of the door guard of FIGS. 1 and 2;

DESCRIPTION OF THE PREFERRED EMBODIMENT

Figure 5:
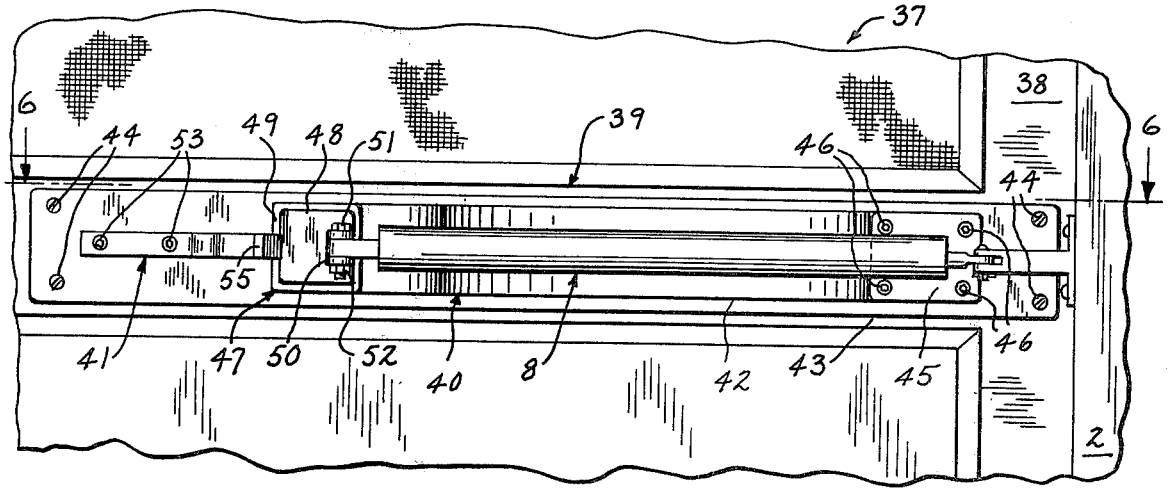
FIG. 5 is a fragmentary side view in elevation of a door assembly showing a door guard constituting a second embodiment of the present invention.

Referring to the drawings, FIGS. 1 and 2 show a door guard assembly that includes a door 1 swingably mounted in a doorway for horizontal movement about a vertical axis. The door 1 is hung on a stile 2 of the doorway by means of a series of hinges 3, only one of which is shown. Each hinge 3 has one leaf mounted to the outside edge margin of a vertical piece 4 of the door 1, and its other leaf mounted to the outside of the stile 2. Thus, as shown in FIG. 2, the door 1 would swing vertically upward from the drawing towards FIG. 1. The door 1 also includes a cross-piece 5 which separates an upper door panel 6 from a lower door panel 7.

A conventional spring loaded door closer 8 is mounted to the inside of the stile 2 by means of a door closer bracket 9. The door closer 8 includes a rod end pivotally connected to the bracket 9, and a cylinder end pivotally connected intermediate the ends of an elongated, flexible, resilient two-piece arm 10. The two-piece arm 10 extends transversely across the inside of the door 1, and includes an outer end comprised of a movable arm 11 and an inner end comprised of a stationary arm 12.

The outer arm 11 is generally channel-shaped and includes an elongated web 13 and side flanges 14. The cylinder end of the door closer 8 is pivotally connected to the outer arm 11 by means of a bracket 15 mounted to the web 13. The bracket 15 is generally U-shaped, and includes a base and a pair of spaced side flanges 16. The cylinder end of the door closer 8 extends between the flanges 16, and the pivotal connection is provided by a bolt 17 which passes through aligned openings in the flanges 16 and the cylinder end of the door closer 8. The bolt 17 is held in position by a nut 18. The bracket 15 is fastened to the web 13 of the outer arm 11 by means of a pair of screws (not shown) which extend through its base into threaded openings 19 formed in the web 13 of the outer arm 11. A number of openings 19 are provided in the web 13 of the outer arm 11 so that the bracket 15 may be adjustable to the desired position.

The outer arm 11 is an elongated member that includes an inner end extending towards the hanging edge of the door 1 and an outer end extending outwardly therefrom. The side flanges 14 of the outer arm 11 are tapered toward its outer end. As seen in FIGS. 1 and 2, the outer arm 11 is in its locked position and extends transversely across the door 1 with its web 13 lying flat against the inside of the cross-piece 5. The outer arm 11 is adapted to be flexed or pivoted with respect to the door 1 by means of an elbow or pivotal connection at its inner end to the inner arm 12. The inner arm 12 is also channel-shaped and includes a web 20 and side flanges 21. The inner arm 12 is mounted on the inside of the door 1 adjacent its hanging edge by means of screws 22 extending through the web 20 into the cross-piece 5 and vertical piece 4. The outer ends of the side flanges 21 extend beyond the web 20 and straddle or overlap the inner ends of the side flanges 14 of the outer arm 11. A bolt 23 extends through aligned openings formed in the overlapping portions of the side flanges 14,21 and is held in position by a nut 24. The bolt 23 and nut 24 provide the elbow or pivotal connection between the outer arm 11 and the inner arm 12 which permits the outer arm 11 to flex or pivot with respect to the inner arm 12 in a plane normal to the inside of the door 1. Encircling the bolt 23 is a coil spring 25 which provides resiliency for the arm 10 and includes a pair of arms 26,27 extending from its opposite ends. One arm 26 extends outwardly and contacts the web 13 of the outer arm 11, and the other arm 27 extends inwardly and contacts the web 20 of the inner arm 12. If the outer arm 11 pivots or flexes towards the inner arm 12 and away from the door 1, the arms 26,27 apply a torsional force to the spring 25. In turn, the spring 25 applies an equal but opposite force against the outer arm 11 and inner arm 12 to force the arms 11,12 apart and resist further pivoting between these two members.

FIG. 3 illustrates a catch means 28 for releasably attaching the outer arm 11 to the inside of the door 1. The catch means 28 preferably includes a housing 29 secured directly to the corss-piece 5 of the door 1 by bolts 30. The housing 29 has a longitudinal threaded bore 31 formed therethrough with a constriction 32 formed at one end. A ball 33 is disposed within the bore 31, and is biased against the constriction 32 by a coil spring 34. The spring 34 is held within the bore 31 by a plug 35 which threadedly engages the bore 31 so that the force applied by the spring 34 against the ball 33 may be varied by simply turning the plug 35. The ball 33 and constriction 32 are sized such that the spring 34 can force a portion of the ball 33 to extend outwardly from the constriction 32. The catch means 28 is mounted to the cross-piece 5 of the door 1 longitudinally of the outer edge margin of the outer arm 11 such that the portion of the ball 33 that extends from the constriction 32 overlaps the outer edge margin of the outer arm 11, and holds the outer arm 11 flat against the door 1 such that the outer arm 11 is in its locked position. The inner face of the housing 29 is slightly tapered, as at 36, to aid in allowing the outer edge margin of the outer arm 11 to slide past the ball 33 into its locked position.

In order to prevent damage to the door 1, door closer 8, or doorway, the inner arm 12 is first mounted on the inside of the door 1 to the cross-piece 5 by the screws 22, and the outer arm 11 is connected to the cylinder end of the door closer 8 by means of the bracket 15 and bolt 17. The catch means 28 is then properly positioned on the cross-piece 5 such that the outer edge margin of the outer arm 11 may be held behind the ball 33 and against the door 1 with its web 13 flat against the inside of the cross-piece 5. This constitutes the locked position of the door guard of the present invention, as shown in FIGS. 1 and 2. In its locked position, the door guard is passive and allows for normal opening and closing of the door 1. During such normal operation of the door 1, the door closer 8 permits the door 1 to be swung open between a closed position and a maximum open position. Once opened, the spring means within the door closer 8 applies a force on the outer arm 11 to close the door 1. The door guard remains passive and inoperative during the normal opening and closing of the door 1 because the force of the catch means 28 holding the outer arm 11 against the door 1 is greater than the closing force applied on the outer arm 11 by the door closer 8.

The door guard of the present invention becomes active and operational when the force applied to the outer arm 11 exceeds the holding force applied to the outer arm 11 by the catch means 28. Such a situation may occur when the door 1 is in the widest open position allowed by the door closer 8, and a strong force, such as a gust of wind, is applied to the inside of the door 1. When the door 1 is in its widest open position, the door closer 8 is in its fully extended position and acts as a solid link between the outer arm 11 and the doorway to which it is secured. Thus, if the wind exerts sufficient force against the door 1, the outer arm 11 will be released by the catch means 28.

When the outer arm 11 is released by the catch means 28, the door 1 will continue to swing open to a position beyond that which normally would be its widest open position because of the force of the wind being applied against it. As the door 1 continues to swing open, the outer arm 11 pivots or flexes at its elbow in the opposite or closing direction. This flexing is caused by the spring means within the door closer 8, and the force of the wind against the door 1. The result of these movements is that the angle between the outer arm 11 and the inner arm 12 decreases while the angle between the outer arm 11 and door 1 increases. However, as the angle between the outer arm 11 and inner arm 12 decreases, a torsional force is applied to the spring 25 by the arms 26,27. The spring 25 in turn applies an equal but opposite force against the inner arm 11 and outer arm 12 which resists their pivotal movements. Also, as the angle between the outer arm 11 and inner arm 12 gets smaller the corresponding force applied by the spring 25 gets larger in order to increasingly resist such movement. Thus, when the outer arm 11 is released by the catch means 28 and as the door 1 swings to a position beyond its normally maximum open position, the spring 25 resists this further opening movement of the door 1 and slows the rate of movement of the door 1 due to the resiliency it provides the arm 10. The break away action of the outer arm 11 prevents the door closer 8 from bending or being ripped from the stile 2 of the doorway, and the spring 25 prevents the door 1 from swinging open too fast and being damaged. When the wind dies down the resiliency provided by the spring 25 between the arms 11,12 forces the door 1 to close, and the outer arm 11 may be reset behind the catch means 28 by simply snapping its outer edge margin behind the ball 33. The arm 10 is then once again in its locked position and the door 1 is ready to be opened and closed for normal entry and exit.

Figure 6:
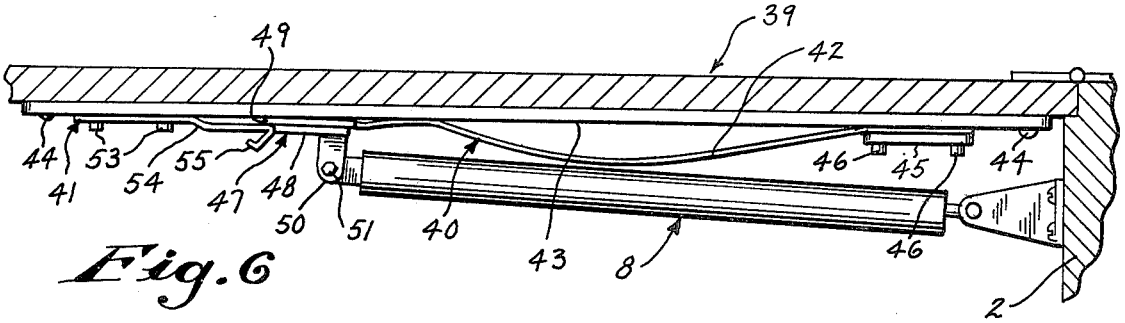
FIG. 6 is a fragmentary top plan view taken through the plane of the line 6—6 indicated in FIG. 5.
Figure 7:
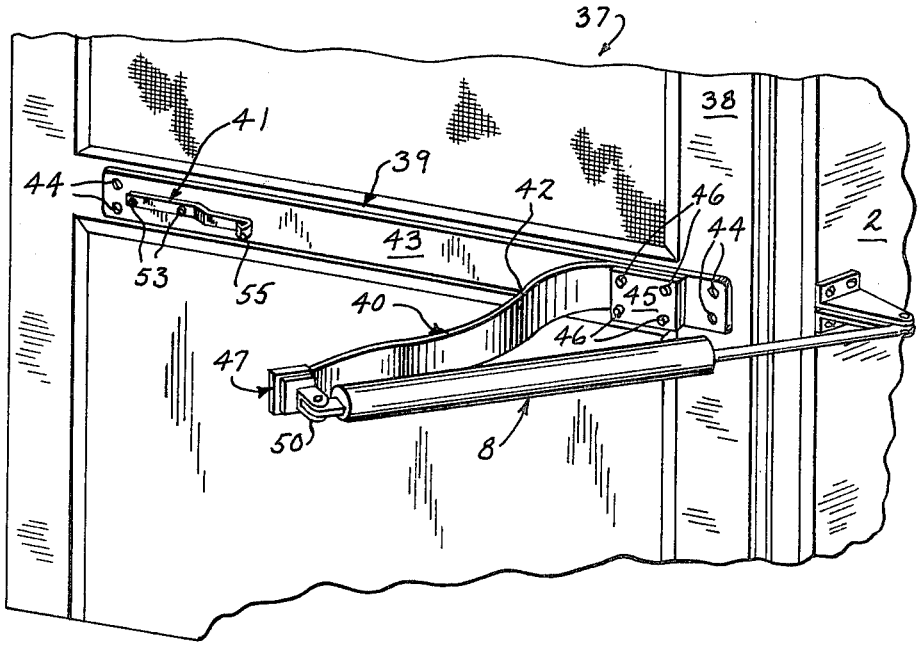
FIG. 7 is a fragmentary view in perspective of a door assembly illustrating the breakaway position of the door guard of FIGS. 5 and 6.

FIGS. 5–7 show an alternate construction for the door guard that constitutes a second embodiment of the invention. The door guard of this embodiment may also be used with a conventional door 37 hung from the stile 2 of a doorway having a vertical piece 38 and a cross-piece 39. This second embodiment of the door guard may also be used with a conventional spring-loaded door closer 8 and includes a one-piece flexible resilient arm 40 and a catch means 41. The arm 40 includes a leaf spring 42 anchored at its inner end to a mounting bar 43. The bar 43 is an elongate, flat piece of approximately the width of the crosspiece 39 that extends transversely across the door 37, and is mounted at one end to the vertical piece 38 and at the other end to the crosspiece 39 by screws 44.

The leaf spring 42 is comprised of a series of curved or bowed strips of metal and includes an inner end secured to the bar 43, and an outer end adapted to be releasably attached to the inside of the bar 43. A base plate 45 sandwiches the inner end of the leaf spring 42 between the plate 45 itself and the bar 43 by means of allen screws 46 which pass through the plate 45 and leaf spring 42 to threadedly engage the bar 43.

The outer end of the leaf spring 42 has a mounting plate 47 attached thereto. The mounting plate 47 is a flat, rectangular-shaped plate having a block 48 welded to its top surface. Three of the sides of the mounting plate 47 project appreciably beyond the edges of the block 48 to form flaps that are tightly crimped around the edges of the outer end of the leaf spring 42 to secure the mounting plate 47 to the leaf spring 42. The block 48 is of lesser width than the mounting plate 47 and thus provides a ledge 49 around the edge margins of the mounting plate 47. A U-shaped bracket 50 is mounted on the block 48 by means of a bolt (not shown) that passes through the web portion of the bracket 50. The bracket 50 is used to pivotally connect the door closer 8 to the outer end of the arm 40. The cylinder end of the door closer 8 extends between the flanges of the bracket 50 and a pivotal connection is provided by a bolt 51 which passes through aligned openings in the flanges of the bracket 50 and the cylinder end of the door closer 8. The bolt 51 is held in position by a nut 52.

The catch means 41 is in the form of a long, narrow strip of metal mounted to the outer end of the bar 43 by means of allen head screws 53. A portion of the catch means 41 is spaced from the bar 43 by means of a bend in the narrow metal strip, as at 54, and ends in a crook or knuckle 55. The catch means 41 is appropriately disposed on the bar 43 so that the ledge 49 of the mounting plate 47 may be releasably attached behind the knuckle 55.

The second embodiment of the invention operates in a manner similar to the first embodiment. Under normal conditions, the arm 40 is locked behind the catch means 41, and the door closer 8 permits the door 37 to be opened and closed with the door guard remaining passive and inoperative. However, when forces are exerted upon the door 37 which attempt to swing the door 37 to a position beyond that which would normally be allowed by the door closer 8, the arm 40 will be released by the catch means 41. Upon being released, the arm 40 is flexed in a closing direction away from the door 37 by the door closer 8, and the door 37 and bar 43 attempt to swing in an opposite or opening direction because of the force of the wind being exerted upon the door 37. However, since the leaf spring 42 is secured to the bar 43 at its inner end and to the mounting plate 47 and door closer 8 at its outer end, its inherent resiliency resists the separation of the door 37 and arm 40. This prevents the door 37 from swinging open too fast and being damaged. The break away action of the arm 40 also prevents the door closer 8 from bending or being ripped from the stile 2 of the doorway. The arm 40 can be reset behind the catch means 41 by simply snapping the ledge 49 of the mounting plate 47 behind the knuckle 55. The door 37 and door closer 8 is then once again operational for normal opening and closing.

While preferred embodiments of the invention have been shown and described, various modifications are obviously possible without departure from the full scope and spirit of the invention. Various catch means, arms, and springs known to those skilled in the art might be substituted. A two-piece arm is not necessary for all applications, and the catch means 28,41 need not necessarily be positioned longitudinally of the arms 11,40 to catch their outer edge margins. The catch means 28,41 may also be positioned above or below the outer arm 11 or mounting plate 47, or anywhere along their lengths and still accomplish their function of providing break away action. It is to be understood that the resiliency of the arm used in the present invention may be provided by the inherent resiliency of the arm itself, such as the leaf spring 42, or by some separate resilient member operating between the arm and door, such as the coil spring 25. It is further to be understood that the resiliency of the arm may vary and must be appropriately selected depending upon the desired application. Thus, greater resiliency may be necessary with heavier doors than with lighter doors.

I claim:

1. A door guard for a swingable door that is mounted in a doorway having a door closer affixed to the doorway comprising:

a flexible resilient arm for extension transversely across the inside of the door, said arm being adapted to be anchored at one end to the door and having its other end adapted for relative movement with respect to the door; and connection means for pivotally connecting the arm to the door closer at a point intermediate the ends of said arm so that when the door opens to its normally widest open position the arm flexes to permit the door to continue opening and slows the rate of movement of the door to prevent damage to the door, door closer and doorway.

2. A door guard according to claim 1, wherein:

the relative movement of said arm is in a plane normal to said door.

3. A door guard for a swingable door that is mounted in a doorway having a door closer affixed to the doorway comprising:

a flexible resilient arm for extension transversely across the inside of the door, said arm being adapted to be anchored at its inner end to the door and having its outer end adapted to be releasably attached to the door;

connection means for pivotally connecting the arm to the door closer at a point intermediate the ends of said arm; and catch means adapted to be mounted on said door for releasably attaching the outer end of the arm to the door so that when the door opens to its normally widest open position allowed by the door closer the outer end of the arm will release and flex to permit the door to continue opening while at the same time slow the rate of movement of the door to prevent damage to the door, door closer and doorway.

4. A door guard according to claim 3, wherein:

the inner end of said arm includes an inner arm anchorable to said door; and the outer end of said arm includes an outer arm pivotally connected to said inner arm for horizontal flexing about a vertical axis.

5. A door guard according to claim 4, wherein:

said pivotal connection includes a coil spring disposed about said vertical axis, said spring having one end extending outwardly against the outer arm and its other end extending inwardly against the inner arm so that the spring resists the flexing of the outer arm.

6. A door guard according to claim 4, wherein:

said connection means includes a bracket disposed intermediate the ends of the outer arm.

7. A door guard according to claim 3, wherein:

said arm includes a leaf spring.

8. A door guard for a swingable door that is mounted in a doorway having a door closer affixed to the doorway comprising:

an inner arm anchorable to the inside of the door;

an outer arm for extension transversely across the door, said outer arm being pivotally mounted at one end to said inner arm for horizontal flexing about a vertical axis and adapted to be releasably attached at its other end to said door;

a coil spring disposed about said vertical axis having one end extending outwardly against the outer arm and its other end extending inwardly against the inner arm so that as the outer arm flexes the spring is torsionally compressed to resist the flexing of the outer arm;

connection means for pivotally connecting the outer arm to the door closer at a point intermediate the ends of said outer arm; and catch means adapted to be mounted on said door for releasably attaching the outer arm to the door so that when the door opens to its normally widest open position allowed by the door closer the outer arm will release from the door and flex to permit the door to continue opening while at the same time the coil spring resists the flexing to slow the rate of movement of the door to prevent damage to the door, door closer and doorway.

9. A door guard for a swingable door that is mounted in a doorway having a door closer affixed to the doorway comprising:

a flexible resilient leaf spring for extension transversely across the inside of the door, said spring being anchorable at its inner end to the door and having its outer end adapted to be releasably attached to the door;

connection means for pivotally connecting the outer end of the leaf spring to the door closer; and catch means adapted to be mounted on said door for releasably attaching the outer end of the leaf spring to the door so that when the door opens to its normally widest open position allowed by the door closer the outer end of the leaf spring will release from the door and flex to permit the door to continue opening while at the same time the leaf spring resists the flexing to slow the rate of movement of the door to prevent damage to the door, door closer and doorway.

10. In a door assembly having a swingable door mounted in a doorway with a door closer affixed to said doorway, a door guard comprising:

a flexible resilient arm extending transversely across the inside of the door, said arm being anchored at one end to the door and having its other end adapted for relative movement with respect to the door; and connection means for pivotally connecting the arm to the door closer at a point intermediate the ends of said arm so that when the door opens to its normally widest position the arm flexes to permit the door to continue opening and slows the rate of movement of the door to prevent damage to the door, door closer and doorway.

* * * * *